United States Patent [19]

Asick et al.

[11] 4,386,819

[45] Jun. 7, 1983

[54] RF SHIELDED ASSEMBLY HAVING CAPACITIVE COUPLING FEATURE

[75] Inventors: John C. Asick, Harrisburg; Leon T. Ritchie, Mechanicsburg; Clair W. Snyder, Jr., York, all of Pa.

[73] Assignee: AMP Incorporated, Harrisburg, Pa.

[21] Appl. No.: 297,543

[22] Filed: Aug. 31, 1981

[51] Int. Cl.[3] ..... H01R 4/66

[52] U.S. Cl. ..... 339/147 R; 339/14 R; 339/143 R

[58] Field of Search ..... 339/14 R, 143 R, 147 R, 339/20 B, 210 R, 136, 141; 323/182, 183

[56] References Cited

U.S. PATENT DOCUMENTS

| | | | |
|---|---|---|---|
| 3,573,677 | 4/1971 | Detar | 333/183 |
| 4,113,341 | 9/1978 | Hughes | 339/147 R |
| 4,206,962 | 6/1980 | Shue et al. | 339/147 R |
| 4,272,148 | 6/1981 | Knack | 339/143 R |

OTHER PUBLICATIONS

"Electromagnetic Shielded Connector," IBM Tech. Discl. Bull. vol. 15, No. 1, 6/1972 pp. 34, 35, Bund et al.

*Primary Examiner*—Eugene F. Desmond
*Attorney, Agent, or Firm*—Russell J. Egan

[57] ABSTRACT

An RF, EMI shielding assembly is disclosed having the capability of capacitively coupling the shielding to system ground so that there will be no ground currents flowing and shocks and arcing will be substantially eliminated. The assembly has a pair of metal shells enclosing a standard connector terminating a shielded cable and a capacitor assembly forming a capacitor with the shells. The capacitor assembly includes springs which make engagement with an equipment closure to effect the capacitive coupling assuring like ground potential throughout the thus connected system.

14 Claims, 7 Drawing Figures

RF SHIELDED ASSEMBLY HAVING CAPACITIVE COUPLING FEATURE

An RF shielding assembly is disclosed having a capacitive coupling feature to provide ground of the same potential for an entire associated system.

There are many instances when components of an electronic system are physically separated by some distance and therefore are not necessarily at the same ground potential. When there is a potential difference in ground between separated components, a ground current will flow which can, in turn, interfere with signals, cause a hazard of shock from touching any of the components, and cause arcing throughout the system.

The present invention overcomes the above problems by providing an RF-EMI shielded connector assembly having a capacitive coupling feature. The assembly has a pair of mating metal shells which substantially enclose a known connector terminating a shielded cable and contact the shielding of the cable. The assembly further has a spring loaded capacitive coupling system which assures that all components joined by the associated cabling will have the same ground potential.

It is known to have an electrical connector containing at least one electronic component and used to provide an inexpensive "fix" for an existing circuit. By this means it is possible to add components to the existing circuit without undergoing an extensive circuit redesign. An example of such a connector may be found in U.S. Pat. No. 4,206,962.

However, it is not known to have an electronic component in an electrical connector with that component playing an active role in the effectiveness of the interconnection.

The present invention overcomes the above-mentioned problems by providing a shielding assembly for use in combination with a known electrical connector. The shielding assembly can also provide a capacitive coupling between the shielding of a shielded cable and the cover or door of an equipment enclosure. Such a coupling will assure that ground will be at the same potential for all portions of a system. The subject shielding assembly is formed by a pair of mating metal shells having a cable engaging portion and a connector engaging portion extending at right angles to each other from a central cavity. The cable engaging portion forms a generally cylindrical passage and has exterior ribs adapted to be received within the shield of the cable. An annular ring is crimped against the cable shield to secure it to the metal shells. The connector engaging portion of the shells is adopted to enclose a known electrical connector leaving the mating portion thereof exposed. A capacitor assembly can be included on the side of the shells opposite the connector engaging portion. The capacitor assembly provides coupling for ground between the shell and a door or lid of the cabinet enclosing the cabled electronic component.

It is therefore an object of the present invention to produce a low profile, right angle, RF shielding assembly for use in combination with a known electrical connector and which can ground the connector and its associated cable at a common ground potential for the entire associated electronic system.

Embodiments of the present invention will now be described by way of example with reference to the accompanying drawings in which.

Figure 1:
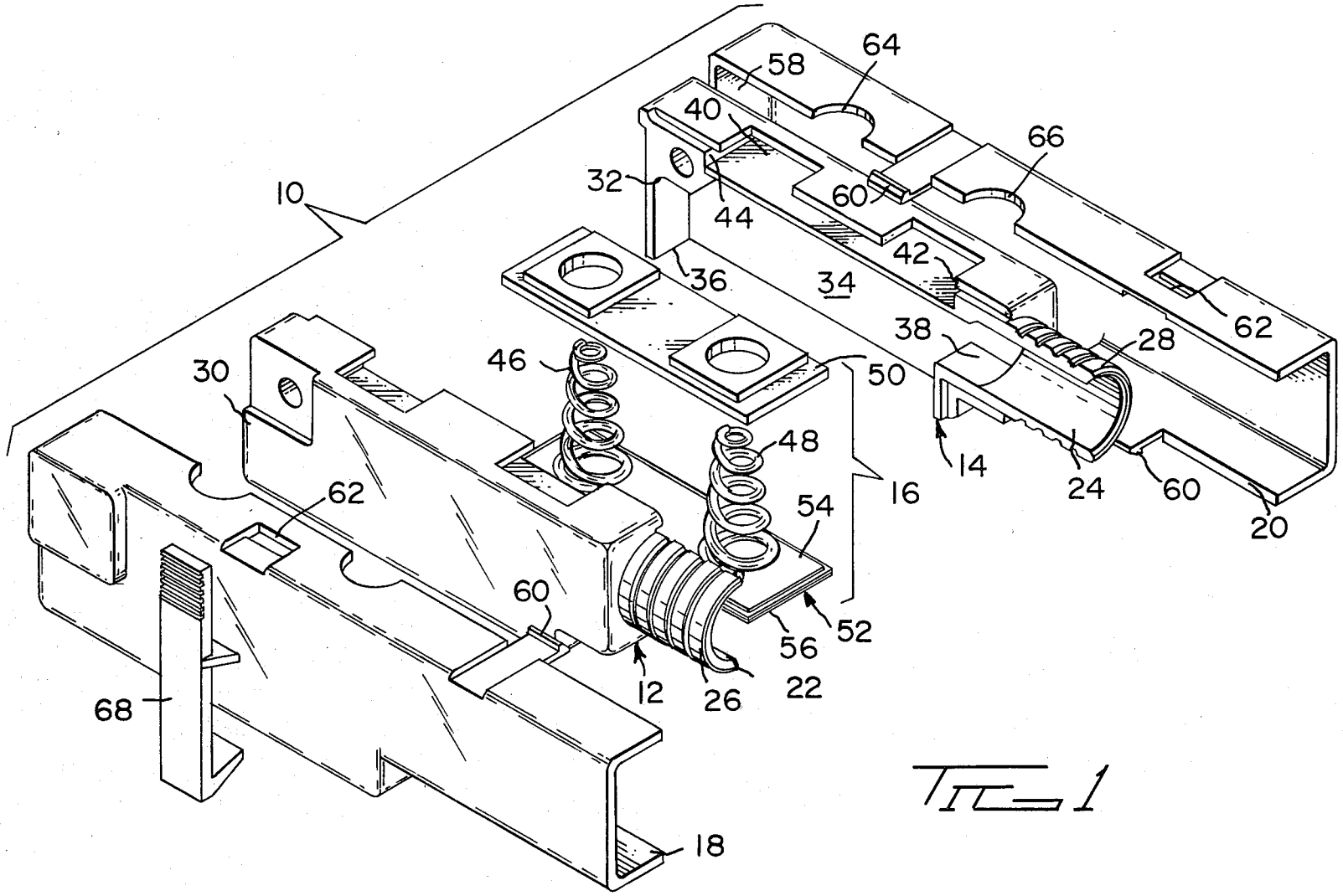
FIG. 1 is an exploded perspective view of the components forming the preferred embodiment of the subject invention.
Figure 2:
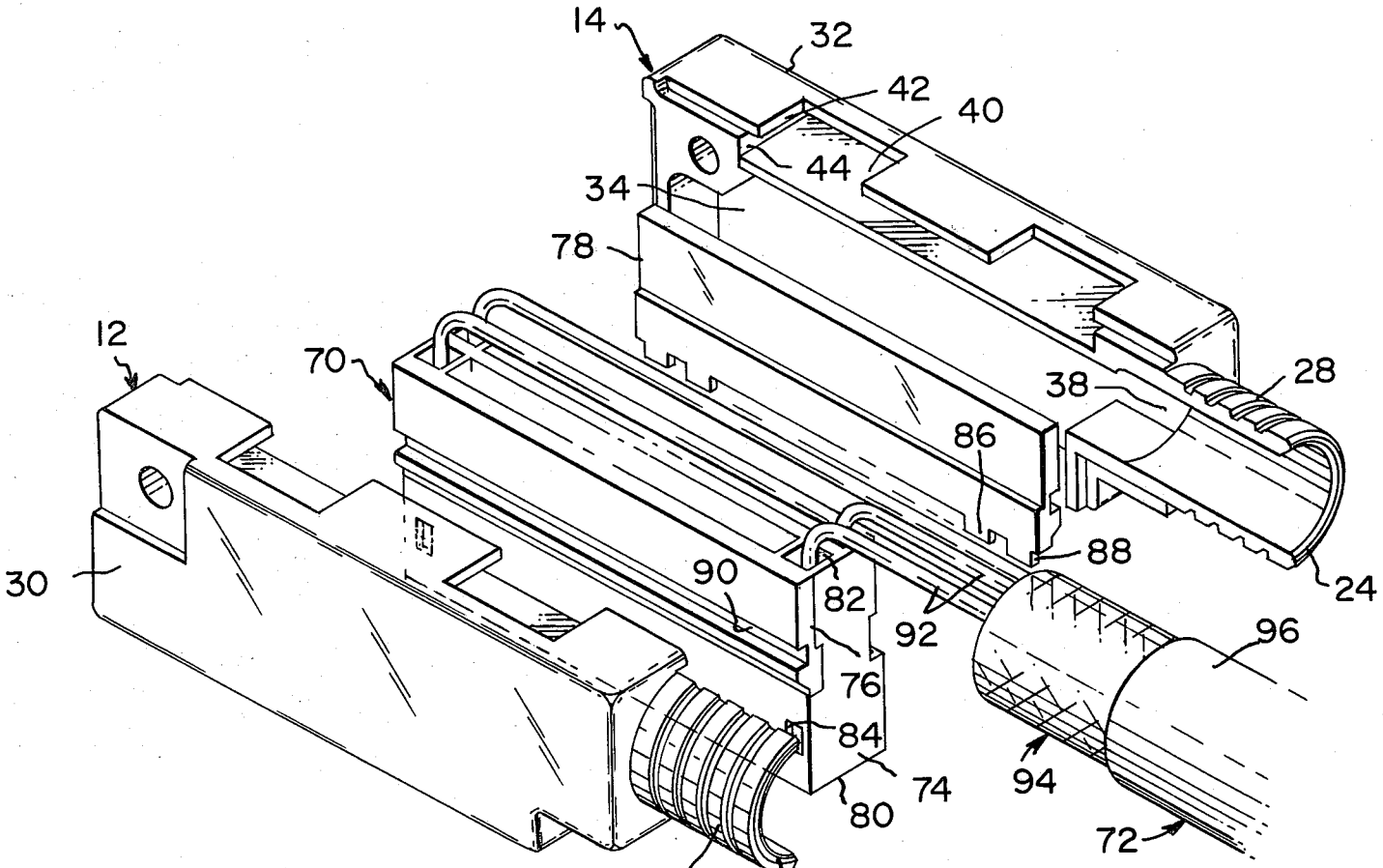
FIG. 2 is an exploded perspective view of the mating metal shells of the subject invention together with a known electrical connector terminating a shielded cable.

The components of the subject shielding assembly 10 are best seen in FIG. 1 and include a pair of interlocking metal shells 12, 14, a capacitor assembly 16 and a pair of interlocking insulating covers 18, 20.

The metal shells 14, 16 each have a semi-cylindrical cable entry portion 22, 24, each with a plurality of outwardly directed ribs 26, 28. The main bodies 30, 32 of the shells 14, 16 together define a profiled cavity 34 with a connector receiving opening 36 and cable passage 38 within entry portions 22, 24. The shells 12, 14 also define an outwardly directed profiled recess 40 having a peripheral lip 42 overhanging an annular groove 44.

The capacitor assembly 16 has a pair of spring members 46, 48, an insulative spring retainer 50, and a capacitive circuit 52 formed by a metal plate 54 on a flexible insulative substrate 56. The spring members 46, 48, retainer 50, and circuit 52, are inserted into the recess 40 of one shell 14, 16 and held in place by engagement of the other shell. The plate 54, insulative web 56 and shells 14, 16 form a capacitor. While the springs 46, 48 have been shown as conical, clearly other spring configurations are suitable for use in the subject invention as will be noted from the later discussion of the alternate embodiment. However, it should be noted that the conical spring shown does have the advantage of not readily snagging on clothing or equipment thereby facilitating handling of the subject assembly.

The covers 18, 20 are formed of an insulative material and together define a cavity 58 which encloses the mated shells 12, 14 and a portion of the cable extending therefrom. The covers include intermating latching means 60, 62, profiled apertures 64, 66 through which the springs 46, 48 extend, and assembly latches 68.

Figure 3:
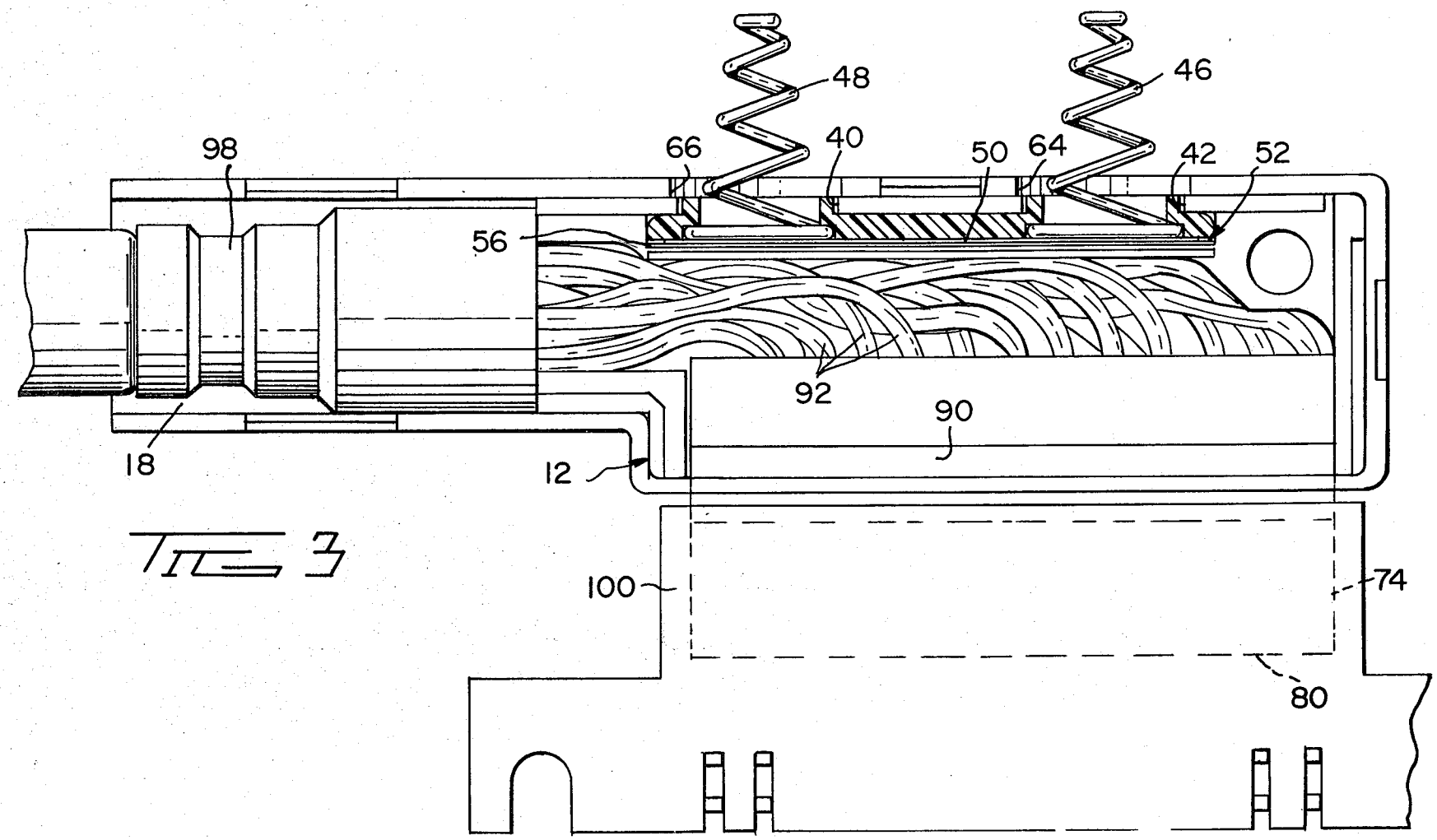
FIG. 3 is a side elevation, partly in section, of the subject invention fully assembled with the known electrical connector and shielded cable of FIG. 2.

The subject invention is used in combination with a known electrical connector 70 and shielded cable 72. The illustrated connector 70 is of the type disclosed in U.S. Pat. No. 4,243,288, the disclosure of which is incorporated herein by reference. The connector 70 includes a housing 74, a pair of covers 76, 78 and a plurality of terminals (not shown but preferably of the type shown in FIG. 3 of the noted patent). The housing 74 is an elongated member of rigid plastics material having a mating face 80 with a plurality of terminal passages 82 opening therein in a pair of aligned rows. The sides of the housing are open at the rear so that the passages 82 are enclosed at their forward ends and are channel-shaped opening outwardly at their rearward ends. The housing 74 can also be provided with apertures 84 each aligned with a respective passage 82 and spaced rearwardly of the mating face 80. Each cover 76, 78 has a housing engaging edge portion 86 including a plurality of tines 88 each aligned to be received within the enclosed portion of a respective passage 82. The covers also include an outwardly directed profile 90 for gripping engagement with the edge of the adjacent shell 12, 14.

The shielded cable 72 illustrated is of a known type with a plurality of insulated conductors 92 enclosed in a braided shield 94 which in turn is enclosed in an insulative sheath 96.

The subject invention is assembled by placing the springs 46, 48 on the metal plate 54 of circuit 52 and then placing the retainer 50 over them. The thus formed capacitor assembly 16 is then placed in recess 40 of one shell 12, 14 with the springs 46, 48 projecting therefrom. The terminated connector 70 would next be placed in the cavity 34 of the same shell with the cable 72 extending from passage 38. The rim of opening 36 would engage in recess 90 of the adjacent cover to correctly position the connector 70 in the shell. The other shell would then be mated with the loaded shell and the two shells 12, 14 secured together by conventional means, such as a bolt and nut or screw (not shown). The braid 94 of the cable 72 would be expanded over the ribs 26, 28 of the portions 22, 24 and secured thereto by application of an annular crimp ring 98. The outer covers 18, 20 would then be snap fitted over the entire assembly.

Figure 4:
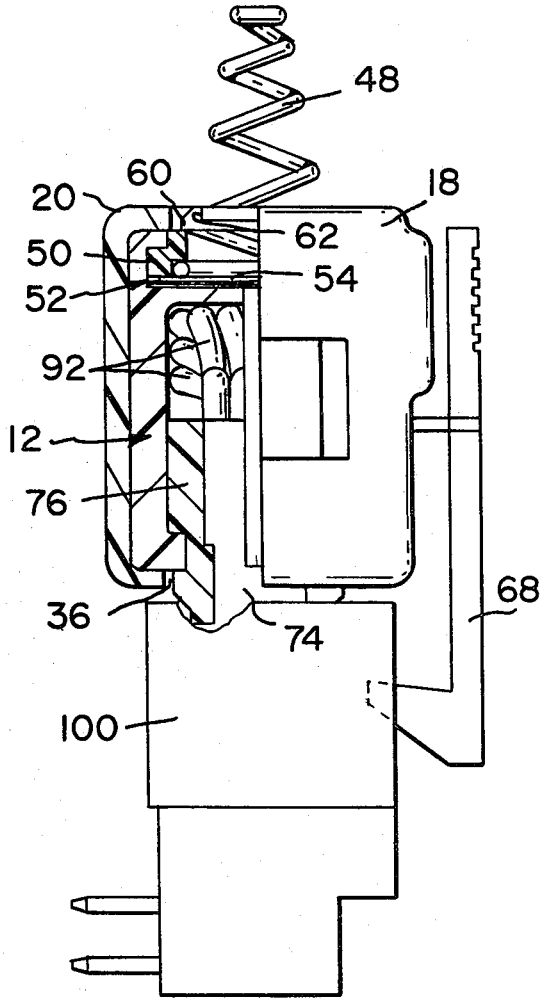
FIG. 4 is an end view, partly in section, of the assembly of FIG. 3.

The thus formed connector would now be ready for mating with a header 100 (FIGS. 3 and 4) on some equipment (not shown). It will be noted that the latch 68 will assure retention of the connector and that the springs 46, 48 are exposed to be engaged with an equipment door or cover (not shown) when such is closed.

It will be appreciated that when a metal enclosure engages the springs 46, 48, the capacitor formed by the shells 12, 14 and plate 54 will come into play and assure that ground potential will be the same throughout the system. At high frequencies the RF is grounded and a low impedance path is provided. At low frequencies the effect is an open circuit.

It should be noted that if conical 46, 48, as illustrated, or helical springs (not shown) are used, then there may be an inductive aspect induced into the operation of this connector. This probably will not have a meaningful effect, due to the size of the components. However, it would only be beneficial.

Figure 6:
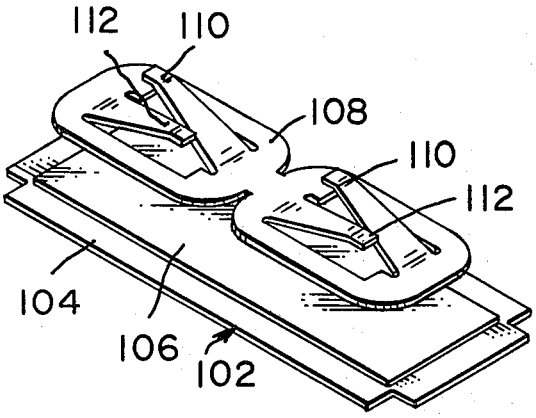
FIG. 6 is an exploded perspective view of the alternate capacitor assembly of FIG. 5.
Figure 7:
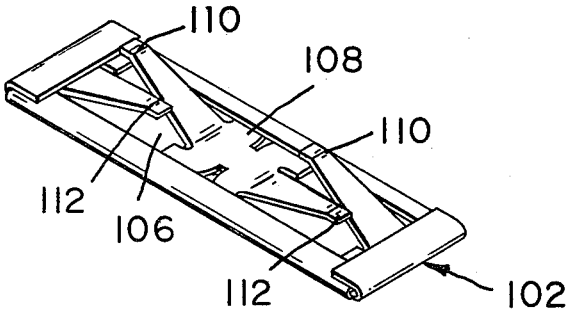
FIG. 7 is a perspective view of the alternate capacitor assembly of FIGS. 5 and 6 as it would be received in the metal shells of the present invention.
Figure 5:
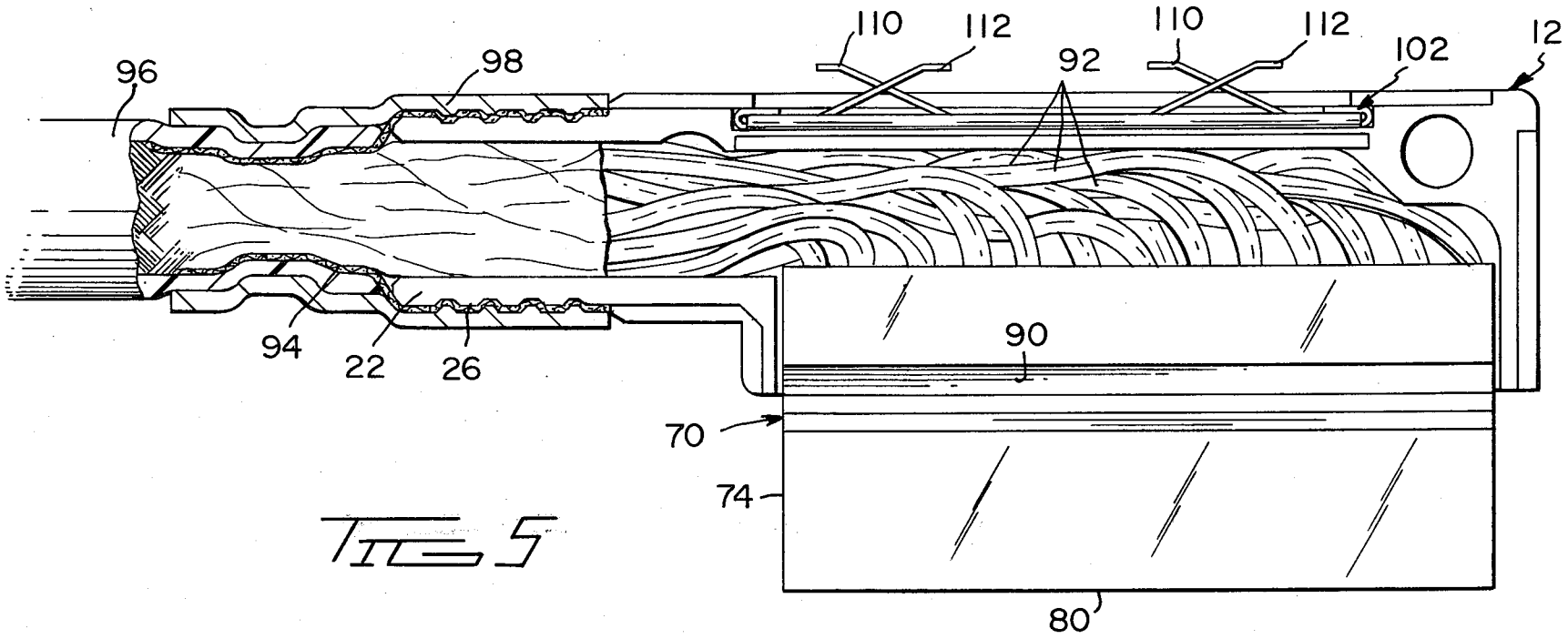
FIG. 5 is a side elevation, partly in section, showing an alternate capacitor assembly for the present invention.

An alternate capacitor assembly 102 is shown in FIGS. 5 to 7. This is formed by a web of flexible insulative material 104, a metal plate 106, and a spring plate 108, having at least two cantilever spring arms 110, 112 stamped therefrom and bent out of the plane of the plate 108. Two or more plates 108 are stacked on the web 106 and the periphery thereof is folded over the edge of plate 108 to fully insulate the plate from the shells 12, 14 thereby forming the above discussed capacitor.

It should also be noted that the subject assembly can be utilized in a number of different configurations. For example, it can be assembled with either capacitor assembly 16 or 102 or this assembly can be omitted. This would still provide an acceptable shielded connector but without the system ground. Likewise, the covers 18, 20 could be omitted if space and other conditions warranted.

We claim:

1. In combination with an electrical connector terminating a shielded cable, shielding means providing capacitive coupling to ground all cabled equipment to like ground potential, comprising:

a pair of mating metal shells together defining a cavity having an opening forming a connector engaging face, said cavity receiving said connector therein with its mating portion exposed at said face, and a cable entry extending at right angles to said cavity and through which said cable extends;

annular crimp ring adapted to secure shielding of said cable to the mated shells; and a capacitor assembly received in said shell members in extending in the opposite direction from said connector engaging face, said capacitor assembly engaging a closure of the cabled equipment to assure like ground potential for the entire system.

2. The shielding means according to claim 1 wherein said capacitor assembly comprises:

a metal plate;

at least one spring means having a first end engaging said metal plate and an opposite second end extending from said shells; and insulative means at least partially surrounding said plate to isolate it from said shells to form a capacitor therewith;

whereby said shielding means is capacitively coupled to system ground potential.

3. The shielding means according to claim 2 wherein said insulative means is a flexible web having said metal plate mounted centrally thereof with the edges of said web folded over said metal plate.

4. The shielding means according to claim 2 wherein said insulative means comprises:

a rigid member having at least one spring mounting opening therein and received against a first side of said metal plate; and a web received against the opposite side of said metal plate.

5. The shielding means according to claim 2 wherein said at least one spring means comprises:

a conical spring.

6. The shielding means according to claim 2 wherein said at least one spring means comprises:

a resilient metal plate having at least one cantilever beam extending from the plane thereof.

7. The shielding means according to claim 1 further comprising:

a pair of interlocking covers of insulative material enclosing said shells and having apertures through which said capacitor assembly is exposed.

8. The shielding means according to claim 7 further comprising:

latching means integral with said covers.

9. Means to provide RF, EMI shielding to a conventional electrical connector terminating a shielded cable, said means comprising:

a pair of mating metallic shells defining a connector receiving cavity with a mating face opening into said cavity and from which said connector projects, said shell members each having semicylindrical tail portions adapted to be received within a shielding portion of said shielded cable and defining a cable entry to said cavity;

clamp means adapted to apply compressive force to said cable shielding creating good electrical and mechanical connection between said cable shielding portion and said tail portions; and a capacitor assembly adapted to form a capacitor with said shells and couple said means to system ground, whereby all components connected by said cable have a like ground potential so that no ground currents flow within the system.

10. The means according to claim 9 wherein said capacitor assembly comprises:

a metal plate;

means to insulate said plate from said shells; and spring means engaging said plate and extending from said shells.

11. The means according to claim 9 further comprising:

a cover of insulative material substantially enclosing said shells.

12. The means according to claim 11 further comprising:

latching means integral with said cover.

13. A method for providing system ground of the same potential so that ground currents are obviated, said method comprising the steps of:

interconnecting components of an electronic system with shielded cable terminated with known connectors;

enclosing each said connector with a pair of mating shell members;

connecting shielding of said shielded cable to said shell members;

forming a capacitive coupling between said shells and system ground whereby ground potential is the same throughout the system and no ground currents flow.

14. An RF, EMI shielding assembly comprising:

a pair of mating metal shell members together defining a connector receiving cavity having a mating face opening and a cable entry extending at right angles thereto;

crimp means to secure shielding of a shielded cable to the mated shells;

capacitor means received in said shell members to form a capacitor therewith and extend in the opposite direction from said mating face opening; and cover means enclosing said mated shell members.

* * * * *